US005151046A

United States Patent [19]

Korsunky et al.

[11] Patent Number: 5,151,046

[45] Date of Patent: Sep. 29, 1992

[54] ELECTRICAL TERMINAL WHICH HAS OVERSTRESS PROTECTION

[75] Inventors: Iosif Korsunky, Harrisburg; Dimitry G. Grabbe, Middletown, both of Pa.

[73] Assignee: AMP Incorporated, Harrisburg, Pa.

[21] Appl. No.: 766,869

[22] Filed: Sep. 27, 1991

[51] Int. Cl.[5] ..... H01R 13/08

[52] U.S. Cl. ..... 439/326

[58] Field of Search ..... 439/296, 326-328, 439/629-637

[56] References Cited

U.S. PATENT DOCUMENTS

| | | | |
|---|---|---|---|
| Re. 26,692 | 10/1969 | Ruehlemann | 339/176 |
| 3,199,066 | 8/1965 | Eledge et al. | 339/176 |
| 3,631,381 | 12/1971 | Pittman | 339/176 MP |
| 3,795,888 | 3/1974 | Nardo et al. | 339/176 MP |
| 3,848,952 | 11/1974 | Tighe, Jr. | 339/91 R |
| 3,920,303 | 11/1975 | Pittman et al. | 339/176 MP |
| 4,136,917 | 1/1979 | Then et al. | 339/17 L |
| 4,185,882 | 1/1980 | Johnson | 339/176 MP |
| 4,557,548 | 12/1985 | Thrush | 339/258 P |
| 4,558,912 | 12/1985 | Coller et al. | 339/64 M |
| 4,575,172 | 3/1986 | Walse et al. | 339/75 MP |
| 4,737,120 | 4/1988 | Grabbe et al. | 439/326 |
| 4,984,996 | 1/1991 | Watanabe et al. | 439/326 |
| 5,015,196 | 5/1991 | Yamada | 439/326 |
| 5,061,200 | 10/1991 | Lee | 439/326 |
| 5,064,381 | 11/1991 | Lin | 439/326 |

FOREIGN PATENT DOCUMENTS

| | | | |
|---|---|---|---|
| 1129580 | 5/1962 | Fed. Rep. of Germany | 21/22 C |

*Primary Examiner*—Joseph H. McGlynn
*Attorney, Agent, or Firm*—Bruce J. Wolstoncroft

[57] ABSTRACT

An electrical connector for connecting a first printed circuit board to a second printed circuit board has terminal contacts which provide a reliable electrical connection. The contact terminals are positioned adjacent to a board receiving recess, and are configured to make an electrical connection with the second printed circuit board when the second printed circuit board is rotated to a second position. Overstress members, provided on the contact terminals, prevent the contact terminals from being deformed as the second printed circuit board is moved relative to the contact terminals. The overstress members are also configured to provide a reliable and relatively short pathway over which the electrial signals may travel between the boards.

20 Claims, 4 Drawing Sheets

ELECTRICAL TERMINAL WHICH HAS OVERSTRESS PROTECTION

FIELD OF THE INVENTION

The present invention relates to electrical terminals which are provided in an electrical connector. More particularly, the invention is directed to electrical terminals which have integral overstress protection means provided thereon to insure that the terminals will not take a permanent set as the printed circuit boards are inserted between contact surfaces of the contacts.

BACKGROUND OF THE INVENTION

Low insertion force electrical connectors for making electrical connections between printed circuit boards are well known in the industry. Examples of these types of connectors are disclosed in U.S Pat. Nos. 3,795,888; 3,848,952; 3,920,303; 4,136,917; 4,185,882; 4,575,172; and 4,737,120. The connectors disclosed in these patents are of the type which have a pair of spring contacts which allow insertion of the printed circuit boards into contact areas of the connectors under reduced insertion force conditions.

Many of these prior art connectors are provided with contacts which have a steep force/deflection curve. Consequently, the spring contacts can easily take a permanent set even if the contacts are displaced only a small amount. Therefore, there is a strong likelihood that the insertion of a thick daughter board into the connector will cause the contacts to take a permanent set. The connector is thereby rendered ineffective when the thick board is replaced by a relatively thin board.

U.S. Pat. No. 4,737,120 teaches of a contact which has a low spring rate or a shallow force/deflection curve. This allows the contacts to have a large tolerance to the thickness of the daughter board, thereby preventing the contacts from taking a permanent set as the daughter board is inserted between the contact areas of the contacts. However, even in a connector which has contacts with a low spring rate, it is conceivable that as the daughter board is brought into engagement with the contacts, the daughter board may damage the contacts, causing the contacts to take a permanent set. This problem is magnified when the daughter board is misaligned with the opening provided between the contact areas of the contacts.

It would therefore be beneficial to provide a connector which has contacts which have means to prevent overstress of the contacts, even when the daughter board is improperly inserted into the connector.

SUMMARY OF THE INVENTION

The invention is directed to contacts for use in a card edge connector. The contacts are provided with overstress members which insure that the contacts portions will not be damaged, or take a permanent set, as the daughter boards are inserted into the connectors, even if the daughter boards are improperly aligned with the contact portions of the contacts. The overstress protection members also provide the path over which the signals travel.

The contacts provide the electrical connection between a first printed circuit board and the daughter board or second printed circuit board. The contacts have a base, a post portion, a contact section, and a bight. The post portion cooperates with contact areas of the first printed circuit board and the contact section cooperates with the contact areas of the second printed circuit board. An overstress projection cooperates with the bight so that as the second printed circuit board is inserted into the contact section, the contact section will not be deformed beyond its elastic limit. The bight also provides a wiping action relative to the overstress member to ensure that a positive electrical connection is effected therebetween.

The invention is also directed to an electrical connector for connecting a first printed circuit board to a second printed circuit board, the second printed circuit board being rotatable relative to the first printed circuit board between a first and a second position. The electrical connector has a housing with a recess provided therein which extends from proximate a first end of the housing to proximate a second end of the housing, and is dimensioned to receive the second printed circuit board therein. Contact terminals are positioned adjacent to the recess, and are configured to make an electrical connection with the second printed circuit board when the second printed circuit board is in the second position in the recess.

The contact terminals have base portions for securing the contact terminals in the housing, post portions for making electrical connection with the first printed circuit board, and resilient contact sections for making electrical connection with the second printed circuit board. The resilient contact sections have bights which extend therefrom. The bights cooperate with overstress members of the contact terminals to provide for the mechanical and electrical characteristics required for a stable and reliable connection over many cycles.

DETAILED DESCRIPTION OF THE INVENTION

Figure 1:
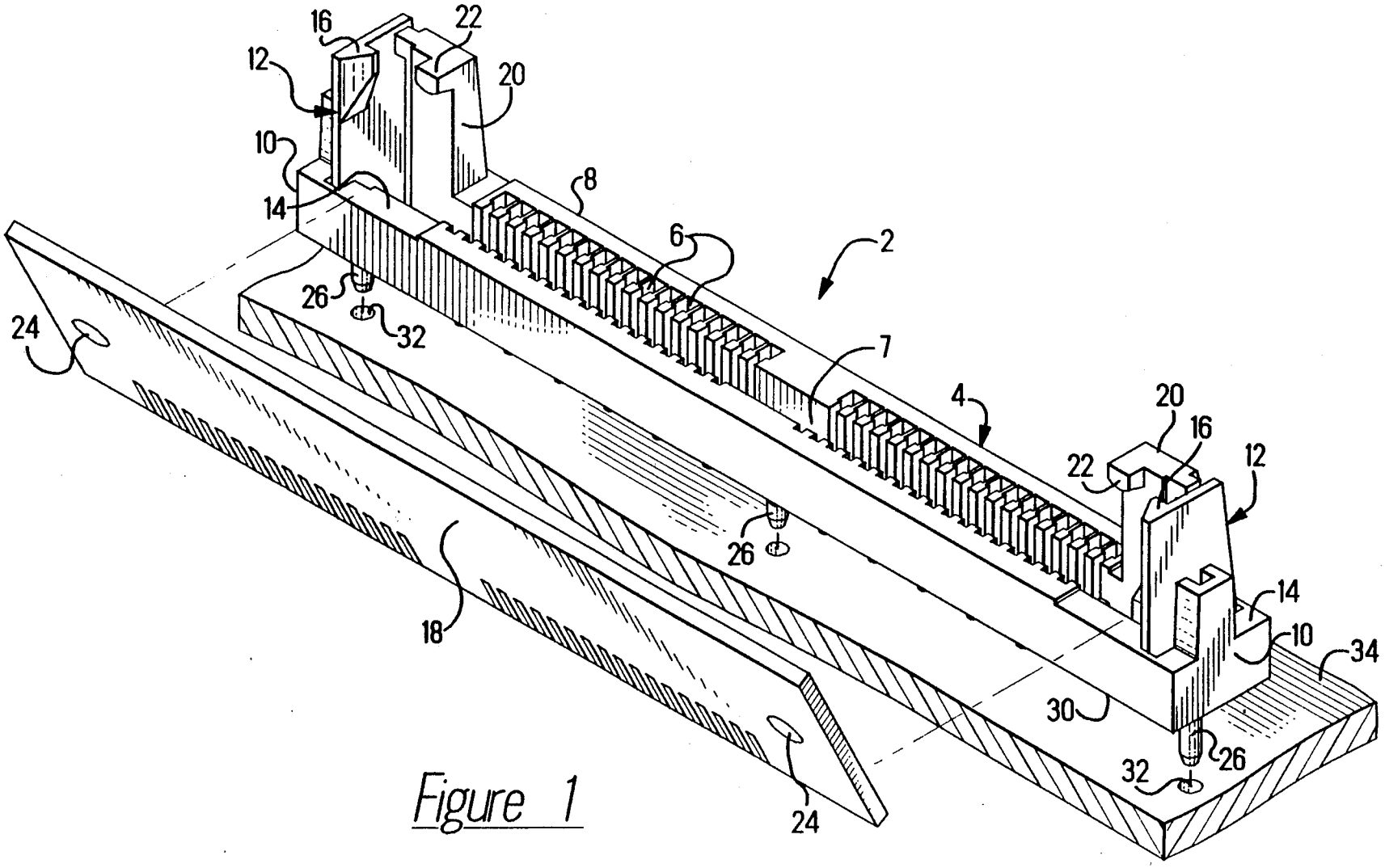
FIG. 1 is a perspective view of a connector which houses the electrical contacts of the present invention, a daughter board is shown in a preinserted position.

Referring to FIG. 1, there is illustrated a low insertion force electrical connector 2 according to the present invention. Connector 2 electrically and mechanically connects two circuit panels together as needed.

The connector is comprised of an elongated housing 4 having a plurality of contact receiving cavities 6 located in an elongated base 8. The housing 4 is made from any material having the required dielectric and mechanical characteristics. A board receiving recess 7 is provided in the base and extends essentially the entire length of the base.

Proximate ends 10 of the base 8 are latch members 12 which project from a top surface 14 of the base. Each latch member 12 is essentially parallel to the ends 10 of the base 8 and has latching projections 16 positioned proximate the top of the latch member 12. The latching projections 16 of the latch members 12 face each other and cooperate with a daughter printed circuit board 18. The latch members may be integrally molded with the housing as shown, or can be made from metal and inserted into recesses in the housing, as more fully described in U.S. Pat. No. 4,986,765.

Adjacent latch members 12 are stop members 20 which project from the surface 14. Stop members 20 lie in a plane which is essentially perpendicular to the plane of each latch member 12. Proximate the top of the stop member 20 is an alignment projection 22 which cooperates with openings 24 in the daughter board 18 to insure that the daughter board 18 is properly positioned with respect to the connector 2.

Pegs 26 extend from a bottom surface 30 of the base proximate the ends 10 and essentially below the latch members 12. As shown in FIG. 1, pegs 26 cooperate with corresponding holes 32 of a mother board 34, thereby ensuring that the connector 2 is properly positioned on the mother board.

Figure 2:
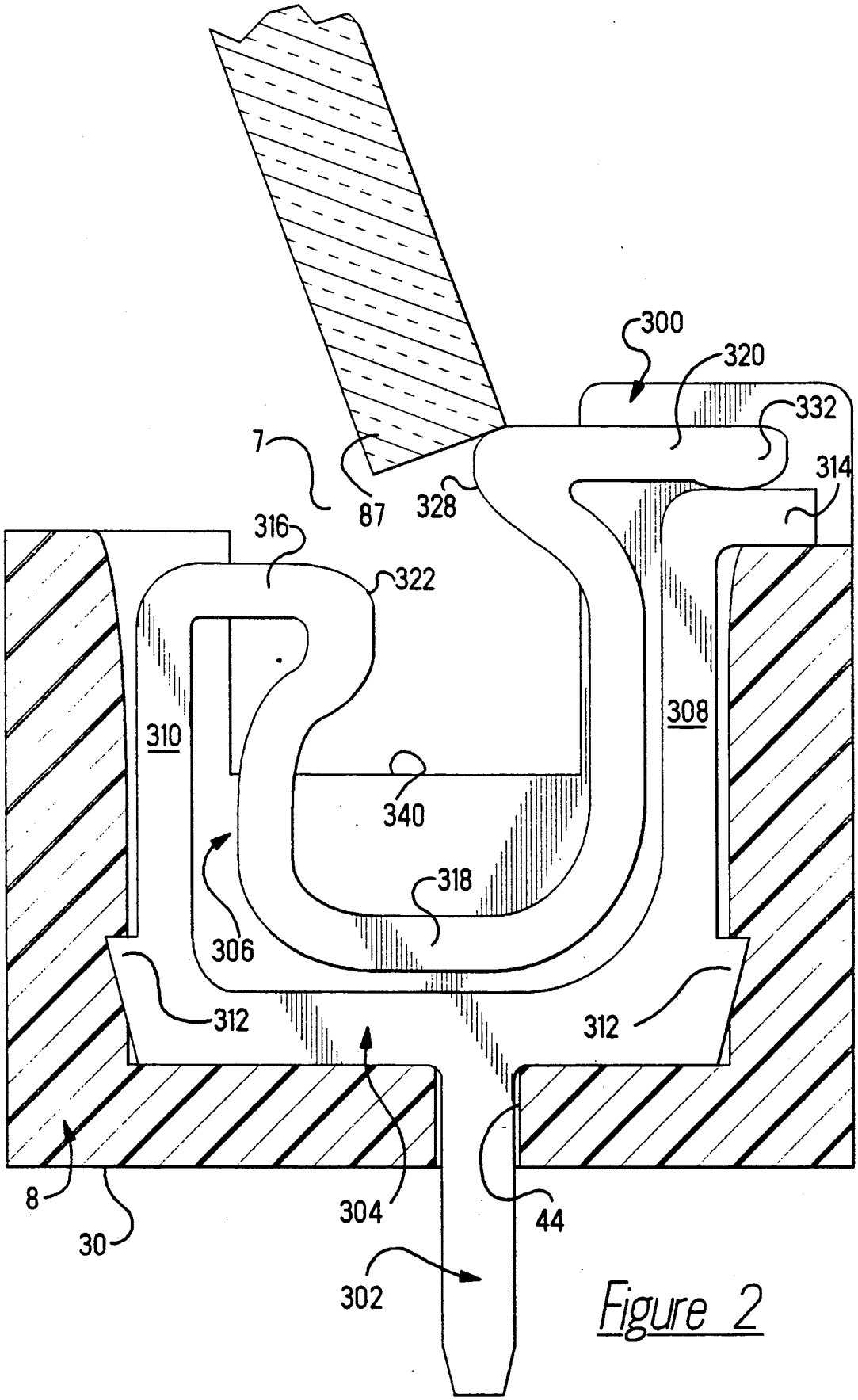
FIG. 2 is a cross-sectional view of the connector showing a daughter board as it is inserted into a contact of the connector, the daughter board is slightly misaligned from the opening of the contacts.
Figure 4:
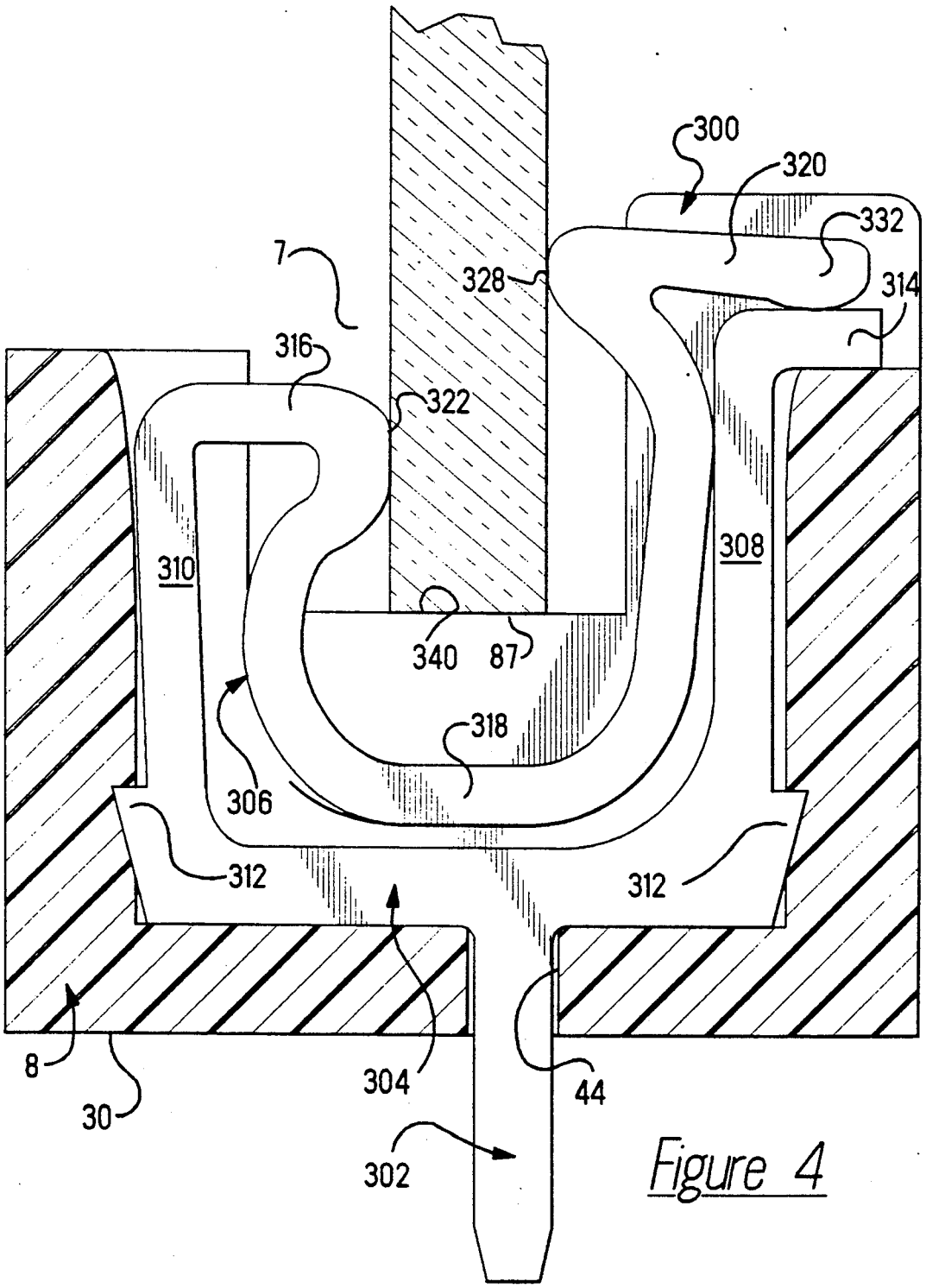
FIG. 4 is a cross-sectional view of the connector, similar to that of FIG. 2, showing the daughter board fully inserted into the connector.

A plurality of contact receiving cavities 6, as shown in FIG. 1 are provided in base 8. The cavities extend from the top surface 14 to proximate the bottom surface 30 of base 8, as is best shown in FIG. 2, 4, and 6. The cavities 6 extend in a direction which is essentially parallel to the ends 10 of the base, with each cavity being provided in communication with a board-receiving opening 7 in the base. The exact shape of the cavities varies according to the shape of the contacts to be inserted therein.

Figure 3:
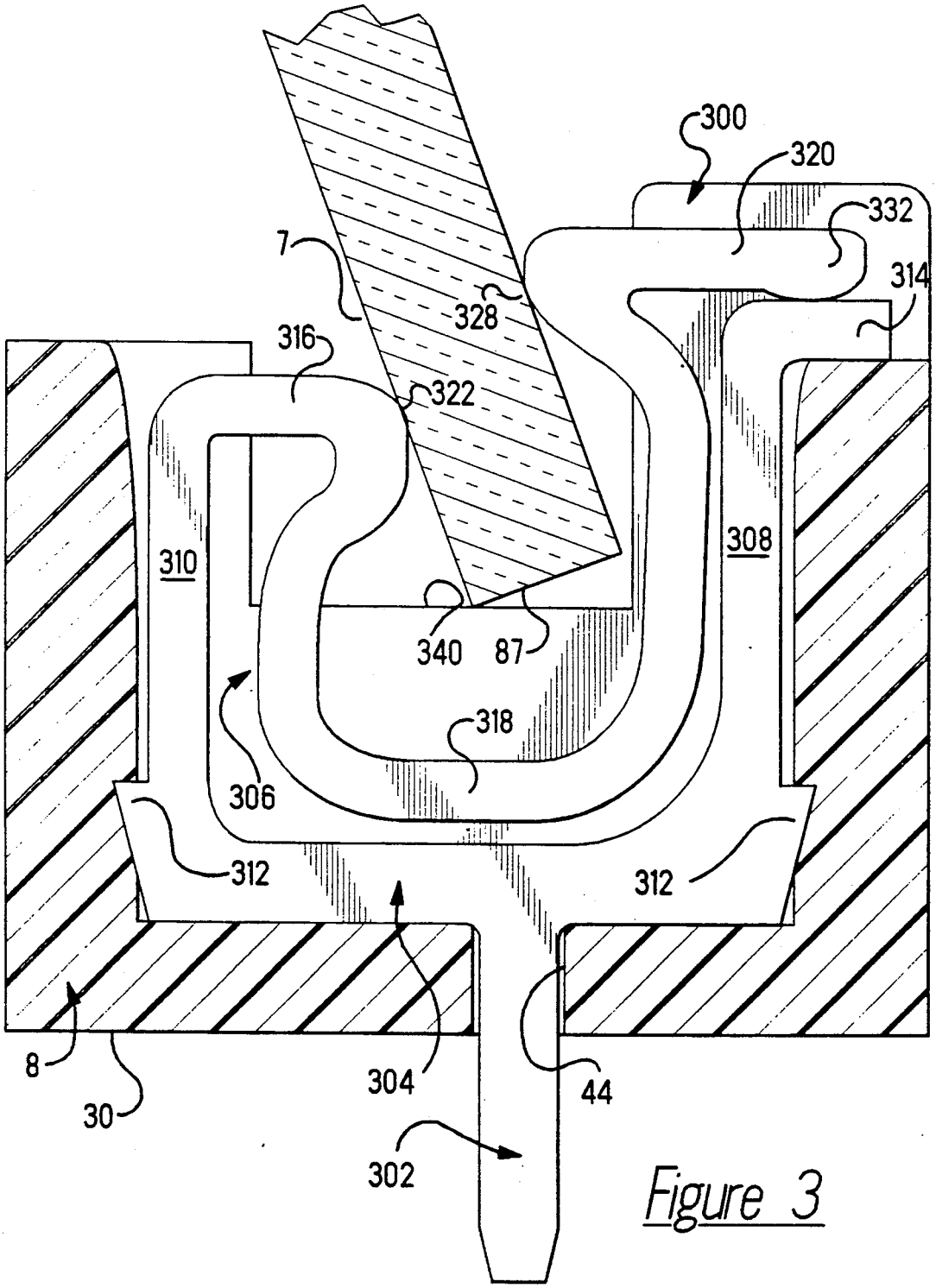
FIG. 3 is a cross-sectional view of the connector, similar to that of FIG. 2, showing the daughter board partially inserted into the connector.

A respective contact 300 is disposed in each contact receiving cavity 6. Each contact 300 is made from sheet metal stock having the desired conductive and resilient characteristics. As shown in FIGS. 2 through 4, the contact is comprised of a post 302, a base 304, and a resilient contact portion 306.

Contacts 300 are positioned in the cavities such that the posts 302 extend through an opening 44 in the bottom surface 30 of the base 8. The lower portions of the posts 302 are aligned with corresponding holes (not shown) of mother board 34 (FIG. 1) and inserted therein, thereby making electrical connections between the contacts 300 and the conductive areas on the mother board 34.

Proper positioning of the posts with respect to the holes of the mother board 34 is assured because pegs 26 properly align connector 2 with respect to the mother board. It should be noted that the lower portions of posts 302 may extend horizontally instead of vertically to allow the posts to be surface mounted to contact areas of the mother board.

The upper portions of the posts remain in the cavities 6 and are connected to base 304. The posts extend from various locations of the base of the contacts 300 in order to allow the posts to meet the desired centerline spacing requirements. This is merely a way of allowing the centerline spacing of the posts 302 to be as close as needed. The movement and operation of each contact 300 is not effected by the positioning of the posts.

The top of each post 302 is integral with some portion of the base 304. Bases 304 engage the walls of the cavities 6 to help secure and stabilize the contacts in the cavities.

As best shown in FIGS. 2 through 4, each base has an overstress member 308 extending from a respective end thereof. The overstress member has a horizontal free end 314 which serves as a contact projection over which the signal transmission may travel. A retention leg 310 of the contact portion 306 extends from the opposite end of the base. Overstress member 308 and retention leg 310 extend from the base 304 in essentially the opposite direction as post 302. Also provided at each end of the base 304 are barbs 312 which cooperate with the housing to retain the contact 300 in the housing.

The contact portion 306 has the retention leg 310 which extends from the base, a first horizontal bight 316 which extends from a free end of the retention leg 310, a U-shaped contact section 318 which extends from the first bight, and a second horizontal bight 320 which extends from the contact section.

The contact section 318 has an arcuate first contact surface 322 and an arcuate second contact surface 328. As shown in FIG. 2 through 4, the contact surfaces 322, 328 are provided on opposite legs of the U-shaped contact section 318. The contact surfaces 322, 328 are spaced from the base 304 at different lengths, thereby allowing the contact surfaces to be staggered.

The second horizontal bight 320 extends from proximate the second contact surface 328 of the contact section 318. The second bight has an enlarged end 332 provided at the free end thereof.

In operation, the terminals or contacts 300 are positioned in the contact receiving cavities 6. Barbs 312 cooperate with the walls of the cavities 6 to maintain the contacts 300 therein. The barbs displace the material of the housing 4 in the typical manner, thereby preventing the removal of the contacts from the housing.

Daughter board 18 is inserted into the cavities 6 at an angle, as shown in FIGS. 2 and 3. This insertion occurs under zero or low insertion force conditions depending on the thickness of the daughter board 18. If the thickness of the daughter board is less than the distance between contact surfaces 322, 328, the insertion force will be zero. If the thickness of the daughter board is greater than the distance between contacts surfaces 322, 328, the insertion will occur under reduced insertion force conditions.

The insertion of the daughter board 18 into recess 7 is done at an angle as shown in FIG. 2. Daughter board 18 is inserted into the opening until a leading corner 87 of the daughter board engages a stop surface 340 of the housing 4, as shown in FIG. 3. For ease of explanation, the insertion of the daughter board will be explained with relationship to a single contact. It is important to note that all of the contacts operate in a similar fashion, and therefore, the explanation of the operation applies to all of the contacts of the connector.

It is conceivable that the daughter board 18 may be slightly misaligned as the board 18 is inserted into the recess 7. When this occurs, it is likely that the board 18 will engage a surface of the contact section 318 proximate the second contact surface 328, as shown in FIG. 2. As the insertion of the board continues, the board will be pushed toward the base 304 of the contact, causing the board to force the contact section 318 to pivot about bight 316 and be deformed toward base 304. If this deformation is not controlled, the contact section 318 and the bight 316 will be damaged, i.e. take a permanent set, thereby rendering the contact 300 effectively useless, as a positive electrical connection will not be effected between the contact and the daughter board.

In order to control the deformation described above, the second bight 320 cooperates with the free end 314 of the overstress member 308 to prevent the overstress of the contact section 318 and the first bight 316.

As the slightly misaligned daughter board is inserted into the recess 7, the leading corner 87 engages the contact section 318, causing the contact section to be displaced toward base 304. This in turn causes the enlarged end 332 of the second bight 320 to exert a downward force (as viewed in FIG. 2) onto the free end 314 of the overstress member 308. The engagement of the second bight with the overstress member prevents further movement of the contact section 318 toward the base 314. Consequently, interaction of the second bight with the overstress member prevents the contact section 318 from taking a permanent set. This overstress feature thereby ensures that the contact section 318 will maintain its desired shape and resilient characteristics even when the daughter board 18 is improperly inserted into recess 7.

The configuration of the contact section 318 allows the contact section to have enhanced resilient characteristics, thereby allowing the contact section to maintain electrical connection with the daughter board during vibration, etc.

Once the daughter board 18 is inserted between contact surfaces 322, 328, as shown in FIG. 3, the daughter board is rotated to the position indicated in FIG. 4. As the board 18 is rotated, first and second contact surfaces 322, 328 are forced toward the walls of the cavities 6. The resilient nature of the contact section 318 ensures that the contact surfaces will oppose the rotation, thereby causing a force to be generated against the daughter board. This force is of sufficient magnitude to maintain the contact surfaces in engagement with the board as the board is rotated. The continued rotation of the board causes the resilient forces supplied by the contact section to increase, thereby insuring that a positive electrical connection will be effected between each contact 300 and the board 18.

As the daughter board is rotated, the second bight 320 is forced to move in a direction which is essentially parallel to the axis of the base 304. During this movement, the enlarged end 332 of the second bight 320 is in contact with the free end 314 of the overstress member 308. This causes the enlarged end 332 to wipe the surface of the free end 314, thereby ensuring that an electrical connection is effected between the ends 332, 314. As the bight 320 is placed in frictional engagement with member 308, the movement of the bight 320 away from the board 18 will be resisted, thereby ensuring that an adequate normal force will be applied to the board 18 by the contact surface 308.

As the position shown in FIG. 4 is reached, the printed circuit board 18 engages latch projections 16 (FIG. 1), thereby securing the board in the fully inserted position.

In the fully inserted position, as shown in FIG. 4, enlarged end 332 and free end 314 remain in engagement. This engagement provides a relatively short electrical pathway over which the electrical signals can travel from the daughter board to the mother board. This becomes particularly important in high speed applications.

To remove the daughter board 18 from the connector 2, latch members 12 must be pushed toward ends 10 of base 8 to disengage latching projections from the board, allowing the board to be rotated in the opposite direction of that previously described. Board 18 is returned to the same angle in which it was inserted and removed under the identical zero or reduced force conditions under which it was inserted. Once the board is removed, the contacts 300 resiliently return to their original position, placing connector 2 in the proper position to repeat the process described above.

The configuration of the contacts 300 provides for a contact which is relatively inexpensive to manufacture and which provides a reliable electrical connection over many cycles. The cooperation of the enlarged end of the second bight with the free end of the overstress member ensures that the contact section will deform within the elastic limit, thereby enabling the contact section to be usable over many cycles. The engagement and movement of the enlarged end and free end also provides the wiping action required to ensure that an electrical connection is effected. This electrical connection provides a relatively short signal path between the daughter board and the mother board.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. An electrical contact for connecting contact pads of a first printed circuit board to contact areas of a second printed circuit board, the contact comprising:

a base;

a post for making electrical connection with the contact areas of the second printed circuit board, the post extends from the base;

a contact section extending from the base, the contact section has first and second contact surface which are provided to make electrical connection with the contact pads of the first printed circuit board;

a bight member provided proximate the second contact surface, an overstress member extending from the base to proximate the bight member, the bight member and the overstress member are provided in frictional engagement whereby as the first printed circuit board is rotated from a first position to a second position the bight member cooperates with the overstress member to prevent the deformation of the contact section beyond its elastic limit.

2. An electrical contact as recited in claim 1 wherein the contact section has an essentially U-shaped configuration, the first and second contact surfaces are positioned on respective legs of the contact section.

3. An electrical contact as recited in claim 1 wherein a retention leg extends from the base in the opposite direction of the post, the retention leg cooperates with the contact section to maintain the contact section in position relative to the base.

4. An electrical contact as recited in claim 3 wherein the first and second contact surfaces of the contact section are staggered with respect to the base.

5. An electrical contact as recited in claim 3 wherein a first bight extends between a free end of the retention leg and the contact section, the first bight allows the contact section to move relative to the retention leg.

6. An electrical contact as recited in claim 5 wherein the first bight extends is a direction which is essentially parallel to the base and essentially perpendicular to the retention leg.

7. An electrical contact as recited in claim 1 wherein the bight member has an enlarged end, the enlarged end cooperates with the overstress member to prevent the deformation of the contact section.

8. An electrical contact as recited in claim 7 wherein the bight member extends in a direction which is essentially parallel to the base.

9. An electrical contact as recited in claim 8 wherein the overstress member has a free end which extends in a direction which is essentially parallel to the base, the free end positioned proximate the enlarged end of the bight member.

10. An electrical contact as recited in claim 9 wherein the second bight is integrally attached to the second contact surface, whereby as the second contact surface is moved, the enlarged end of the bight member will wipingly engage the free end of the overstress member to provide a reliable electrical connection therebetween.

11. An electrical connector for connecting a first printed circuit board to a second printed circuit board, the second printed circuit board being rotatable relative to the first printed circuit board between a first and second position, the electrical connector having a housing with a recess provided therein, the recess extends from proximate a first end of the housing to proximate a second end of the housing, and is dimensioned to receive the second printed circuit board therein, contact terminals are positioned adjacent to the recess, and are configured to make an electrical connection with the second printed circuit board when the second printed circuit board is in the second position, the electrical connector comprising:

the contact terminals have base portions for securing the contact terminals in the housing, post portions for making electrical connection with the first printed circuit board, resilient contact sections for making electrical connection with the second printed circuit board, bights extending from the resilient contact sections, and overstress member extending from the base portions to proximate the bights, the bights and the overstress members are placed in frictional engagement as the second printed circuit board is moved relative to the resilient contact sections to prevent the plastic deformation of the resilient contact sections.

12. An electrical connector as recited in claim 11 wherein the contact sections have an essentially U-shaped configuration, first and second contact surfaces are positioned on respective legs of the contact sections, the first and second contact surfaces are staggered with respect to the bases and cooperate with contact areas of the second printed circuit board.

13. An electrical connector as recited in claim 12 wherein the bights have enlarged ends, the enlarged ends cooperate with the overstress members to prevent the deformation of the contact sections.

14. An electrical connector as recited in claim 13 wherein the second bights extend in a direction which is essentially parallel to the respective bases.

15. An electrical connector as recited in claim 14 wherein the overstress members have free ends which extend in a direction which is essentially parallel to the bases, the free ends are positioned proximate the enlarged ends of the second bights.

16. An electrical connector as recited in claim 15 wherein the second bights are integrally attached to the second contact surfaces, whereby as the second contact surfaces are moved as the second printed circuit board is rotated to the second position, the enlarged ends of the second bights will wipingly engage the free ends of the overstress members to provide a reliable electrical connection therebetween.

17. An electrical contact for connecting contact pads of a first printed circuit board to contact areas of a second printed circuit board, the contact comprising:

a base;

a post portion for making electrical connection with the contact areas of the second printed circuit board, the post portion extending from the base;

an essentially U-shaped resilient contact section positioned proximate the base, the contact section has first and second contact pads of the first printed circuit board;

a bight is provided proximate the second contact surface, an overstress member extends from the base to proximate the bight, the bight is provided in engagement with the overstress member, whereby as the second contact surface is moved between a first position and a second position, the bight is frictionally moved relative to the overstress member to provide a wiping action therebetween.

18. An electrical contact as recited in claim 17 wherein the bight has an enlarged end, the enlarged end cooperates with the overstress member to prevent the permanent deformation of the contact section.

19. An electrical contact as recited in claim 18 wherein the bight extends in a direction which is essentially parallel to the base.

20. An electrical contact as recited in claim 19 wherein the overstress member has a free end which extends in a direction which is essentially parallel to the base, the free end is positioned proximate the enlarged end of the bight.

* * * * *